US006733804B1

(12) United States Patent
Lohrey et al.

(10) Patent No.: US 6,733,804 B1
(45) Date of Patent: May 11, 2004

(54) MULTI-CHAMBERED INFUSION BAG, ESPECIALLY FOR TEA

(75) Inventors: Wilhelm Lohrey, Meerbusch (DE); Wolfgang Groth, Wegberg (DE)

(73) Assignee: Teepack Spezialmaschinen GmbH & Co. KG (DE)

( * ) Notice: Subject to any disclaimer, the term of this patent is extended or adjusted under 35 U.S.C. 154(b) by 0 days.

(21) Appl. No.: 09/787,458

(22) PCT Filed: Aug. 20, 1999

(86) PCT No.: PCT/EP99/06121

§ 371 (c)(1),
(2), (4) Date: May 21, 2001

(87) PCT Pub. No.: WO00/17066

PCT Pub. Date: Mar. 30, 2000

(30) Foreign Application Priority Data

Sep. 17, 1998 (DE) ..... 198 42 526

(51) Int. Cl.[7] ..... B65B 29/04

(52) U.S. Cl. ..... 426/79; 426/82; 426/421; 426/394

(58) Field of Search ..... 426/77–84, 394, 426/421

(56) References Cited

U.S. PATENT DOCUMENTS

| | | | | | |
|---|---|---|---|---|---|
| 2,072,976 | A | | 3/1937 | Andrus | |
| 2,143,302 | A | * | 1/1939 | Cross | 426/79 |
| 2,291,278 | A | * | 7/1942 | Cleaves | 426/82 |
| 2,359,292 | A | * | 10/1944 | Barnett | 426/82 |
| 2,362,459 | A | * | 11/1944 | Barnett | 426/82 |
| 2,791,505 | A | * | 5/1957 | Barnett | 426/79 |
| 2,793,120 | A | | 5/1957 | Bennett | |
| 2,925,171 | A | * | 2/1960 | Eaton | 426/83 |
| 2,939,257 | A | * | 6/1960 | Bartelt | 426/394 |
| 3,053,665 | A | * | 9/1962 | Irmscher | 426/79 |
| 3,223,229 | A | * | 12/1965 | Welin Berger | 426/83 |
| 3,257,212 | A | * | 6/1966 | Kasket | 426/82 |
| 3,542,561 | A | * | 11/1970 | Rambold | 426/79 |
| 3,597,222 | A | * | 8/1971 | Kalemba | 426/79 |
| 3,895,118 | A | * | 7/1975 | Rambold | 426/83 |
| 3,899,599 | A | * | 8/1975 | Rambold | 426/82 |
| 3,914,439 | A | * | 10/1975 | Graves | 426/78 |
| 4,141,997 | A | * | 2/1979 | Syroka et al. | 426/79 |
| 4,651,870 | A | * | 3/1987 | Giambalvo | 426/82 |
| 4,828,851 | A | * | 5/1989 | Romagnoli | 426/79 |
| 4,844,914 | A | * | 7/1989 | Bonne et al. | 426/79 |
| 4,880,651 | A | * | 11/1989 | Christie | 426/394 |
| 4,948,601 | A | * | 8/1990 | Serbu | 426/77 |
| 5,047,252 | A | * | 9/1991 | Liu et al. | 426/79 |
| 5,135,762 | A | * | 8/1992 | Vernon et al. | 426/79 |
| 5,318,786 | A | * | 6/1994 | Clarkson | 426/79 |
| 5,478,581 | A | * | 12/1995 | Christie | 426/77 |

FOREIGN PATENT DOCUMENTS

| | | | | |
|---|---|---|---|---|
| CA | 694466 | * | 9/1964 | 426/82 |
| CH | 415 992 | | 1/1967 | |
| DE | 2500100 | * | 7/1976 | 426/79 |
| DE | 3701230 | * | 8/1988 | 426/78 |
| DE | 90 00 259 | | 4/1990 | |
| EP | 0 226 133 | | 6/1987 | |
| EP | 0 448 325 | | 9/1991 | |
| EP | 574152 | * | 12/1993 | 426/82 |
| FR | 2 194 186 | | 5/1957 | |
| GB | 24151 | * | 12/1904 | 426/79 |
| GB | 962038 | * | 6/1964 | 426/79 |
| GB | 2247001 | * | 2/1992 | 426/78 |

* cited by examiner

*Primary Examiner*—Steve Weinstein
(74) *Attorney, Agent, or Firm*—Cantor Colburn LLP

(57) ABSTRACT

An infusion bag for preparing tea including a suspension unit having a grasping area and at least two chambers for containing an amount of a substance, the chambers each having a top side and being connected to one another at respective top sides to form a common edge. The chambers are connected to the suspension unit at the common edge and are turned away from the grasping area. The suspension unit is preferably longer than the chambers.

11 Claims, 3 Drawing Sheets

Fig.1
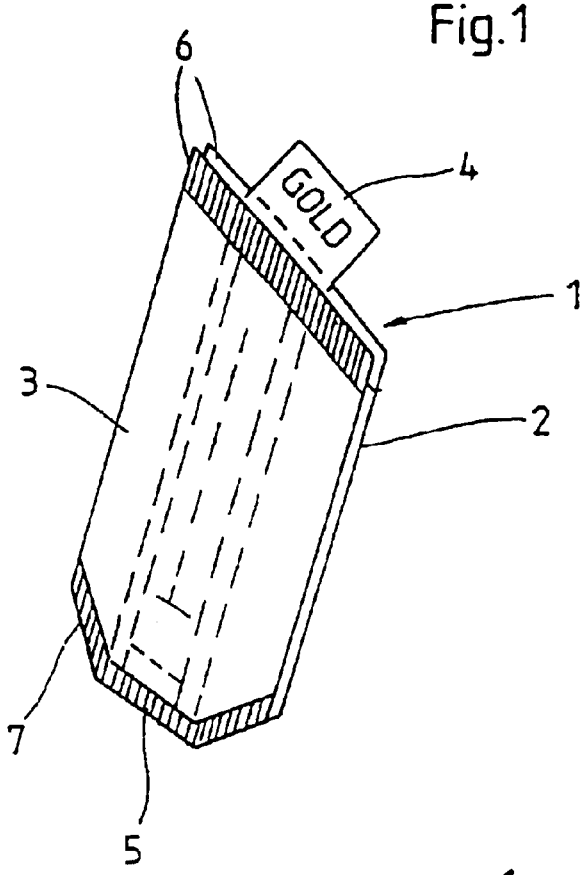
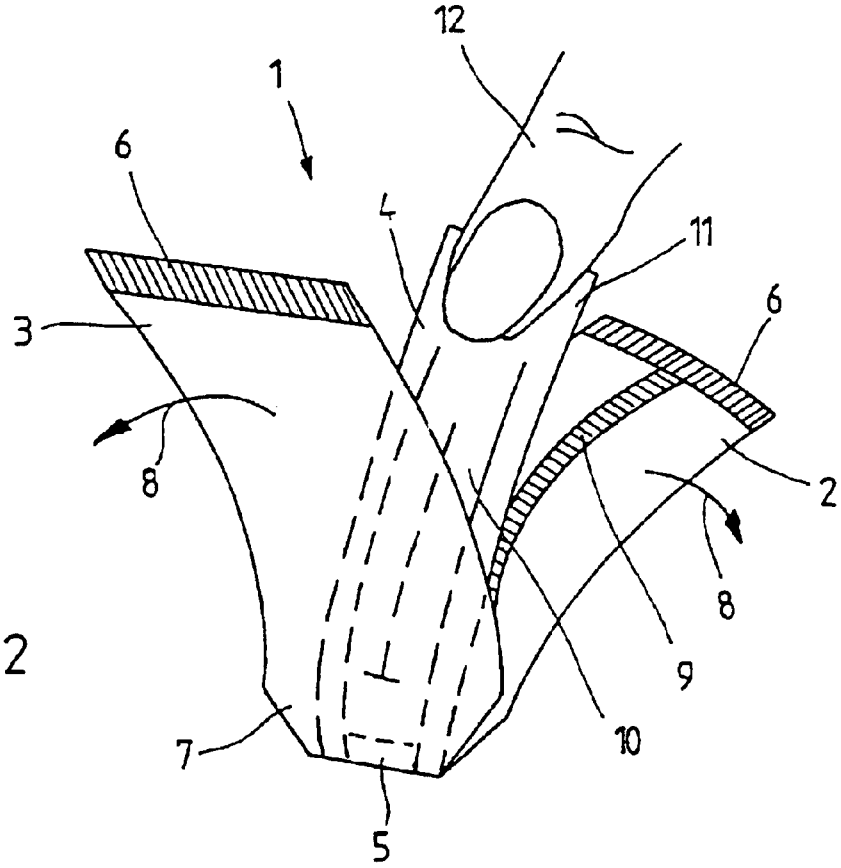
Fig.2

Fig. 4
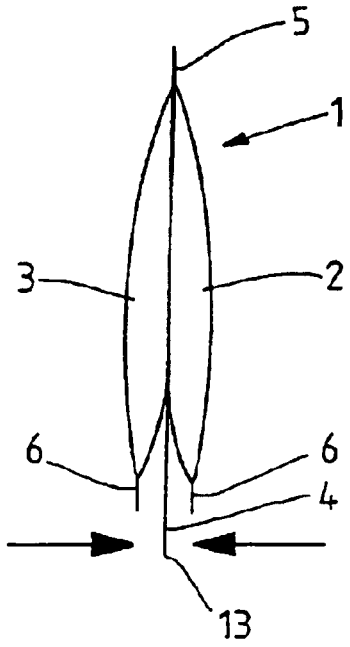
Fig. 6
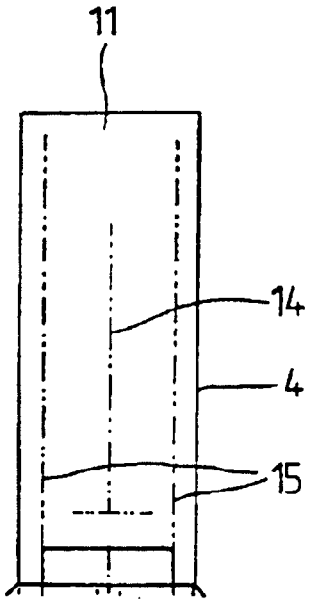
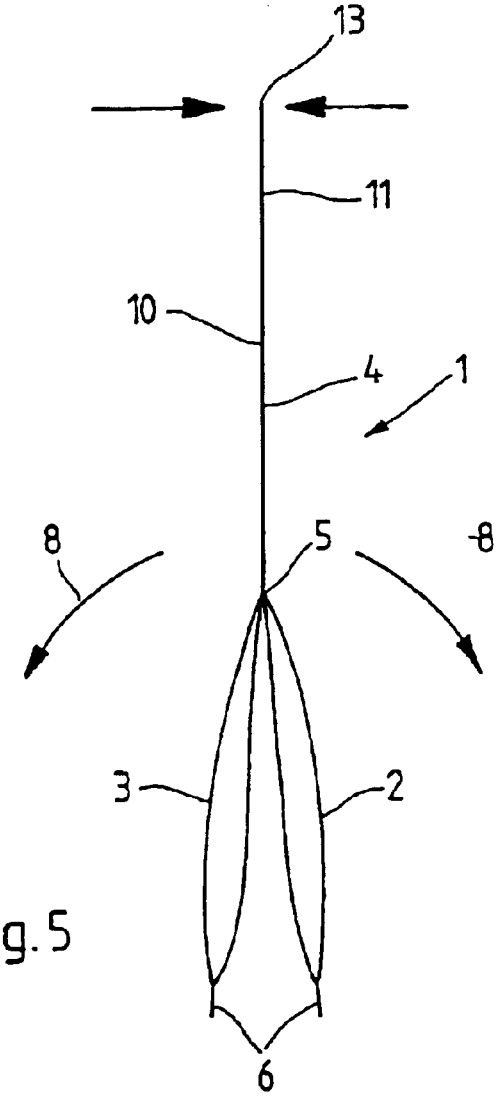
Fig. 5

MULTI-CHAMBERED INFUSION BAG, ESPECIALLY FOR TEA

TECHNICAL FIELD

The present invention concerns an infusion bag, in particular for preparing tea, with a suspension unit made of a sheet-like carrier material with chambers consisting of a filter material, in each case containing an amount of a substance, which are connected with the suspension unit on a common edge.

BACKGROUND OF THE INVENTION

Infusion bags for tea are known in different designs. In particular the use of double-edged infusion bags which have two chambers lying side by side arranged next to each other, which in each case contain an amount of tea in the form of dried and pulverized tea leaves, has become common. The two chambers are connected with one another on the bottom by a transverse fold, also called a bottom fold, and closed on their top end jointly by a connecting edge, on which a thread with a label is fastened. As a rule a top sealing fold for this is made in two procedures, into which fold the edges of the infusion bag are folded in a first procedure and in a second procedure the trapezoidal part remaining at the top is wrapped around. Thereupon the folded-in parts are connected to one another with simultaneous fastening of a thread end. A double-chambered infusion bag of this kind is known, for example in the applicant=s German Patent Specification 1 001 944 and consists of an easily permeable material which makes it possible for the infusion liquid to solubilize the substance to be leached out, in particular the tea, and to dissolve the substances contained. In particular filter paper is used for this.

For fastening the thread to the infusion bag, respectively to the label and, for example, for connecting the top ends of a double-edged infusion bag, it is known to use sealing clamps made of metal—so-called clasps, which are located in the area of the fold of the top end of the infusion bag, respectively on the label. Furthermore it is usual in each case to glue the thread between the top end of the infusion bag and label to this thread, for example by means of material capable of being heat-sealed and the like.

None of the known connecting and/or fastening possibilities guarantees a reliable connection respectively fastening of the infusion bag with the label, respectively the thread. Thus, in particular in the case of the use of a sealing clamp there is no reliable clamping of the thread within the clamp, so that the thread slides out of the sealing clamp relatively easily and thus can loosen from the label, respectively from the infusion bag. In the case of using adhesive connections there is a problem in the precise portioning and positioning of the adhesive and of the thread. In particular in the case of using infusion bags for tea, in the case of which the infusion liquid in general is used in the heated, respectively boiled state, an adhesive connection can be loosened because of the relatively high temperatures and thus become unreliable.

A further essential problem results from the fact that the connecting media, that is the sealing clamps, adhesives, and the like have a flavor-changing, respectively influencing, effect and thus are disturbing for the user.

Moreover, the above-mentioned double-chambered infusion bags have the disadvantage that the chambers lie very close to one another so that the distribution of the tea during the infusion is very unfavorable and is concentrated in a small spatial area.

An infusion bag of the type mentioned initially was known from FR-A-2 194 186. In the case of this infusion bag, a bag which has two chambers is fastened to a suspension unit, which is made of a sheet-like material, for example cardboard, at its top by means of a clamp, is folded in the middle along a line. In this way the bag having two clamps is located in the interior between the two sides of the suspension. Thus the bag assumes the same position both in the packaged condition and when in use, that is, with its top side upwards, whereby in the packaged condition both chambers of the bag are surrounded by the suspension unit.

SUMMARY OF THE INVENTION

Starting from this known prior art the purpose of the invention is to create an infusion bag which has an improved infusion behavior and in spite of its novel appearance can be produced economically.

This purpose is achieved by the invention in that at least two chambers produced and filled independently of one another, with their top side on a common connecting edge, are connected into one unit with the end of the suspension unit turned away from the gripping area, whereby the suspension unit is longer than the chambers.

In the case of the infusion bag according to the invention the chambers lie with their top side downward in the package. The suspension unit, which is longer than the chambers, projects out with its gripping area between the two chambers. This results in the advantage that the free end of the suspension unit can be grasped without the fingers of the user touching the chambers. At the time of grasping the free end and removing the infusion bag out of the package, because of the force of gravity, the chambers independently fold down around the connecting edge, so that the user has hold of the free suspension, while the chambers hang down freely by folding around the connecting edge. Because of the stresses resulting from the folding, the chambers do not lie closely together, so that the materials located in the chambers are loosened and distributed freely, which results in the improved infusion behavior.

In addition there is a novel appearance, since in practice a number of individual tea bags are connected along one edge with their suspension unit. These individual tea bags formed from individual chambers thus form a tea bag bundle. The particular advantage of this configuration is the fact that it can be produced particularly economically. Moreover, in the case of using .a carrier-shaped sheet material as a suspension unit, a label, a thread, and a conventional fastening means, for example a metal clamp or a fastening thread, can be spared.

DE-U 90 00 259.8 does show a suspension unit projecting over the chambers in the form of a rod. However, the chambers are fastened to the suspension unit in the vertical direction over the entire length. The effect of the loosening of the material to be leached out during the unfolding of the bag taken from the package achieved with the invention thus does not take place in the case of the known infusion bag.

Also, the infusion bag known from EP-A-0 448 325 differs fundamentally from the invented object. It has two chambers made simultaneously, which are connected with a label via a thread. Thus the known infusion bag differs fundamentally from the invented object.

The object of the invention disclosed in U.S. Pat. No. 2,072,976 is an object with which portioned water is to be treated. The handle is provided with a sheet of wood or metal, on which porous containers, which contain the chemicals for treating the water, are mounted. The containers are fastened with their top side approximately in the middle of the handle, so that it has no similarity with the invention.

U.S. Pat. No. 2,793,1290 also describes a tea bag which consists of several chambers connected together, which are fastened to a common label via a thread. Thus there is no similarity of the known tea bag with the object of the invention.

According to a further feature of the invention the sheet-like suspension unit is provided with punch holes which form a rectangular area and/or a T-shaped notch.

Furthermore, the invention proposes that each of the chambers be formed from tubular sheets. According to the invention these can consist of a sheet-like filter material, which is formed by welding, in particular heat sealing, of the side edges.

The chambers can be filled with different amounts and/or types of the substance.

The method for producing an infusion bag according to the invention is characterized by the fact that the chambers made independently from one another are supplied to the sheet-like carrier material of the suspension unit simultaneously, and are connected with it. Alternatively the chambers can be made one after the other and connecting, first one of the chambers is connected with the sheet-like carrier material of the suspension unit along a connecting edge and then the at least 2nd chamber is connected with the carrier material and also separated from the sheet.

BRIEF DESCRIPTION OF THE DRAWINGS

Further advantages and features of the invention result from the following descriptions by means of the figures. Here:

FIG. 1 shows a perspective representation of an embodiment of an infusion bag, FIG. 2 shows a representation according to FIG. 1 in a preparation position, FIG. 4 shows a schematic side view of the representation according to FIG. 1, FIG. 5 shows a schematic side view of the representation according to FIG. 3, and FIG. 6 shows a top view of an embodiment for a suspension unit.

DETAILED DESCRIPTION OF THE PREFERRED EMBODIMENT

Figure 3:
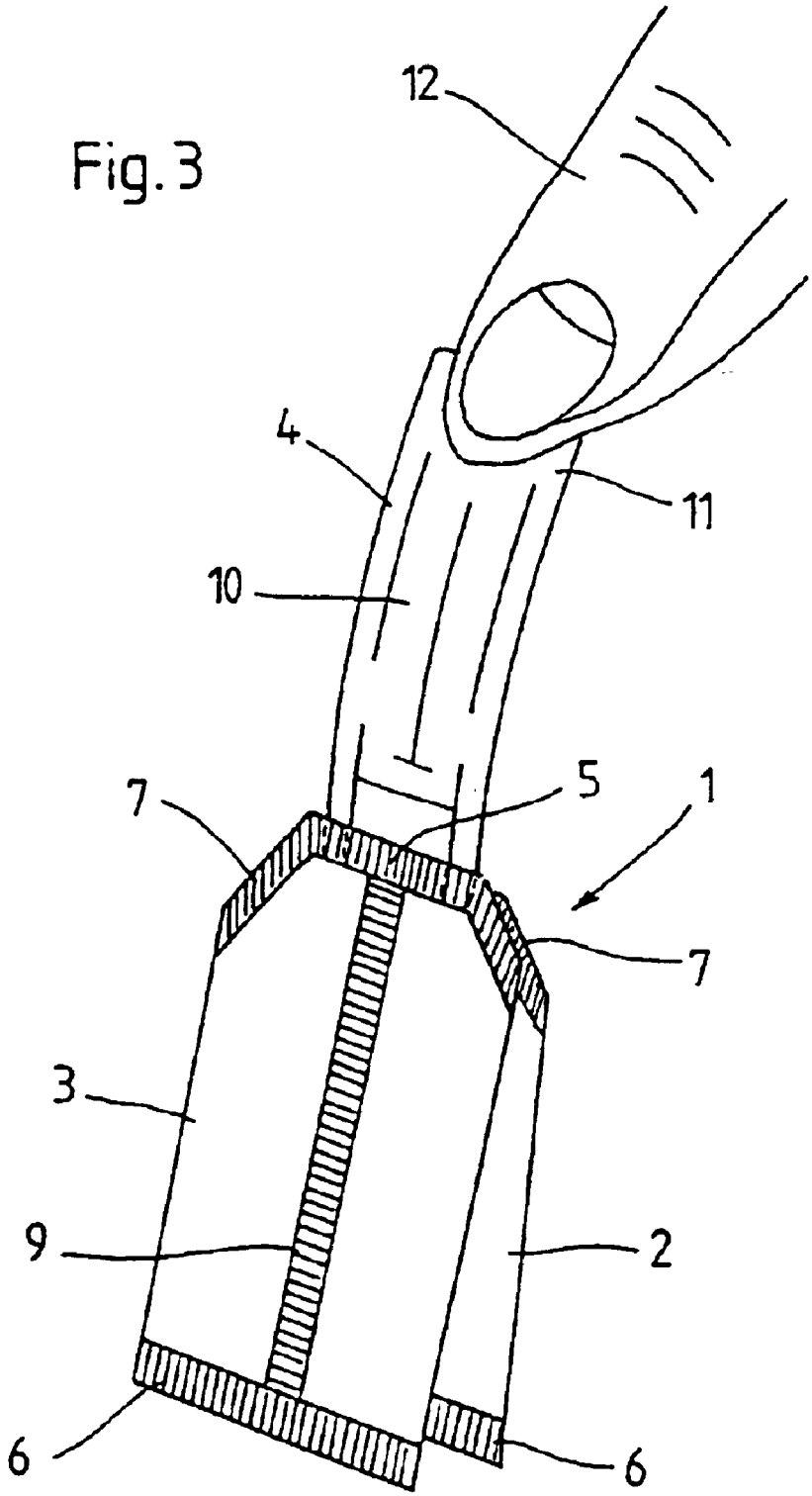
FIG. 3 shows a representation according to FIG. 1 in a use position.

The design for an infusion bag 1 shown in the figures consists of two individual chambers 2 and 3, which are connected with a suspension unit 4 along a connecting edge 5. The chambers are sealed along their edges 6 and 7 and separated from a tubular sheet in a way known per se.

FIG. 1 shows the condition of the infusion bag 1 in its packageable or packaged condition. The suspension unit 4 in the form of a sheet-like carrier strip is longer than the chambers 2 and 3 and thus projects with a free end.

If, as shown in FIG. 2, the suspension unit 4 is grasped in its grasping area 11, as indicated with the finger 12, and the infusion bag 1 is lifted, chambers 2 and 3 fall away from one another in the direction of the arrow 8, whereby they unfold in the area of the connecting edge 5.

After the end of the unfolding, the condition shown in FIG. 3 results, in which the suspension area 10 of the suspension unit 4 lies free and the chambers 2, 3 hang freely ready for infusion. The seam 9 shown in FIGS. 2 and 3 results from the process of producing the chambers 2, 3 out of a hose-shaped sheet. By unfolding the chambers 2, 3 at the time of the transition from the condition according to FIG. 2 to the position according to FIG. 3, the substances located in chambers 2, 3 are loosened and distributed freely in the chambers 2, 3 so that the substances stored in chambers 2, 3 expand well during the subsequent brewing and can develop their full flavor.

The condition of the infusion bag shown in FIG. 1 is shown in FIG. 4 in a side view. FIG. 4 in practice shows the condition of the infusion bag 1 directly after its production. Chambers 2 and 3 are fastened along the connecting edge 5 on the suspension unit 4 and the suspension unit 4 is cut to size in the area of the edge 13.

FIG. 5 shows the condition shown in perspective in FIG. 3 , in which it is easy to see that the chambers 2, 3 hang freely, separated from one another, for improvement of the infusion behavior.

FIG. 6 shows an embodiment for a suspension unit 4, consisting of a strip, for example made of foil, paper, or the like, which is provided with punch holes 1, 15. Suspension unit 5 can be unfolded through punch hole 14. Through the punch hole 15, which is made T-shaped, the suspension unit can be "buttoned", respectively mounted, on a teapot spout, on the cover of the teapot, or otherwise.

Suspension unit 4 is a piece of a preferably printed, and in a given case punched, carrier material. During production this material is moved along a direction of advance and in the embodiment shown is connected first from one side with a chamber 2 then from the other side with a chamber 3. The chambers are separated from their respective cords after the connection is made. After a corresponding advance the suspension unit 4 is separated from the sheet, so that the configuration shown in FIGS. 1 and 4 results.

Different number of chambers can be located on both sides. Of course, the chambers also can have different contents, for example different sorts of tea and/or aromatic substances, in order to prepare mixtures simply in this way.

In addition to the shape for making the chambers 2, 3 shown, it also is possible to make the chambers 2, 3 out of a sheet-like filter material, the side edges of the chambers 2, 3 are sealed, preferably by heat sealing.

The examples described are used only for explanation and are not limiting.

What is claimed is:

1. A method for producing an infusion bag, the method comprising:

forming a suspension unit of a sheet-like carrier material such that said suspension unit includes a grasping area disposed at a first end of said unit;

forming independent of one another at least two chambers of a filter material such that said chambers include a top side and are capable of containing an infusible substance, filling independent of one another said at least two chambers with the substance; and connecting simultaneously each of said at least two chambers at their top sides to said suspension unit such that said at least two chambers are connected to opposite sides of said suspension unit at a common edge of said suspension unit and at an end of said suspension unit opposite said first end, so that said suspension unit is lying between said at least two chambers and so that upon grasping said grasping area, said at least two chambers fall away from said grasping area and one another and unfold down around the connecting, common edge, hanging freely with space between said at least two chambers, wherein said suspension unit is formed to be longer than said chambers.

2. A method for producing an infusion bag, the method comprising:

forming a suspension unit of a sheet-like carrier material such that said suspension unit includes a grasping area disposed at a first end of said unit;

forming successively at least two chambers of a filter material such that said chambers include a top side and are capable of containing an infusible substance, filling successively said at least two chambers with the substance;

connecting a first of said at least two chambers at a first top side to said suspension unit;

connecting a second of said at least two chambers at a second top side to said suspension unit and to said first top side to form a common edge of said at least two chambers; and wherein said suspension unit is formed to be longer than said at least two chambers, wherein said at least two chambers are connected to opposite sides of said suspension unit at a common edge of said suspension unit and at an end of said suspension unit opposite said first end, so that said suspension unit is lying between said at least two chambers and so that upon grasping said grasping area, said at least two chambers fall away from said grasping area and one another and unfold down around the connecting, common edge, hanging freely with space between said at least two chambers.

3. An infusion bag for preparing tea, comprising:

two chambers formed of a filter material for containing an amount of an infusible substance, said chambers being produced and filled with a substance independently of one another, said chambers each having a top side and being connected at respective top sides to form a common edge; and a suspension unit made of sheet like carrier material, said suspension unit having a grasping area disposed at a first end of said suspension unit, wherein said chambers are connected to opposite sides of said suspension unit at said common edge and at an end of said suspension unit opposite said first end, so that the suspension unit is lying between said chambers and wherein the suspension unit is longer than said chambers, and said chambers are connected to said suspension unit such that they are adapted to fall away from said grasping area and one another and unfold down around the connecting, common edge when said grasping area is grasped, so that said chambers hang freely with space between said chambers.

4. The infusion bag according to claim 3, wherein said suspension unit is provided with punch holes which form a rectangular area and/or a T-shaped notch, so that said chambers being turned away from said grasping area when a hanger area is folded out from the suspension unit and arranged on a spout or lid of a pot.

5. The infusion bag according to claim 3, wherein each of the chambers is made out of tubular sheets.

6. The infusion bag according to claim 3, wherein each of the chambers is made out of a sheet-like filter paper material by welding.

7. The infusion bag according to claim 3, wherein each of the chambers is made out of sheet-like filter paper material by heat-sealing of side edges.

8. The infusion bag according to claim 3, wherein the chambers are filled with different amounts of the substance.

9. The infusion bag according to claim 3, wherein the substance comprises tea.

10. The infusion bag according to claim 3, wherein the substance comprises aromatic substances.

11. The infusion bag according to claim 3, wherein said chambers each having a bottom side, said bottom sides are releasably connected to each other.

* * * * *